US005773372A

United States Patent [19]

Ikeyama et al.

[11] Patent Number: 5,773,372

[45] Date of Patent: Jun. 30, 1998

[54] COATED POLYESTER FIBER FABRIC AND A PRODUCTION PROCESS THEREFOR

[75] Inventors: Masami Ikeyama, Yokaichi; Jiro Amano, Takatsuki, both of Japan

[73] Assignee: Toray Industries, Inc., Tokyo, Japan

[21] Appl. No.: 731,833

[22] Filed: Oct. 21, 1996

Related U.S. Application Data

[63] Continuation of Ser. No. 318,678, Mar. 1, 1995, filed as PCT/JP94/00216 published as WO94/18375, abandoned.

[30] Foreign Application Priority Data

Feb. 15, 1993 [JP] Japan ..... 5-25454

[51] Int. Cl.[6] ..... D06M 13/224; B32B 17/00

[52] U.S. Cl. ..... 442/164; 442/65; 442/324; 442/327; 427/287; 427/389.9; 427/393.4

[58] Field of Search ..... 428/265, 266, 428/287; 427/387, 389.9, 393.4; 8/495; 442/68, 164, 324, 327

[56] References Cited

U.S. PATENT DOCUMENTS

| | | | |
|---|---|---|---|
| 3,622,527 | 11/1971 | Dieterica et al. | 260/2.5 AY |
| 3,650,669 | 3/1972 | Osborn | 8/115.5 T |
| 3,906,136 | 9/1975 | Weil | 428/262 |
| 3,936,556 | 2/1976 | Süling | 428/195 |
| 3,963,848 | 6/1976 | Bentley et al. | 428/172 |
| 4,176,108 | 11/1979 | Caimi et al. | 260/29.6 TA |
| 4,262,072 | 4/1981 | Wendling et al. | 430/14 |
| 4,312,914 | 1/1982 | Guth | 428/290 |
| 4,672,005 | 6/1987 | Dyer | 428/474.4 |
| 5,344,688 | 9/1994 | Peterson et al. | 428/102 |

FOREIGN PATENT DOCUMENTS

| | | |
|---|---|---|
| 58-4873 | 1/1983 | Japan . |
| 60-45686 | 3/1985 | Japan . |
| 62-53632 | 11/1987 | Japan . |
| 4-91278 | 3/1992 | Japan . |
| 4-174771 | 6/1992 | Japan . |
| 4-202868 | 7/1992 | Japan . |

*Primary Examiner*—Helen Lee
*Attorney, Agent, or Firm*—Foley & Lardner

[57] ABSTRACT

The present invention provides a coated polyester fiber fabric, produced by coating a polyester fiber structure dyed by a disperse dye, with a resin, comprising an organic peroxide in said coating resin. The present invention also presents a coated polyester fiber fabric, produced by coating a polyester fiber structure dyed by a disperse dye, with a resin, comprising aromatic rings in said coating resin. The present invention furthermore presents a process for preparing a coated polyester fiber fabric, comprising the step of coating a polyester fiber structure dyed by a disperse dye, with a resin solution containing an organic peroxide. The coated polyester fiber fabric of the present invention has excellent fastness against dye migration and staining, and washing durability. On the other hand, the process of the present invention allows said coated fabric to be very simply and stably produced without using any special apparatus, and hence is industrially very effective.

8 Claims, 2 Drawing Sheets

COATED POLYESTER FIBER FABRIC AND A PRODUCTION PROCESS THEREFOR

This application is a continuation of application Ser. No. 08/318,678, filed Mar. 1, 1995, now abandoned, which is 371 of PCT/JP94/00216, filed on Feb. 14, 1994, now WO 94/18375.

TECHNICAL FIELD

The present invention relates to a coated polyester fiber fabric free from disperse dye migration and a production process therefor.

BACKGROUND TECHNIQUES

Coated fabrics presently generally used are usually woven or knitted fabrics of nylon fibers. Various products coated for achieving water-proof water repellency, moisture permeable water repellency, air permeability, melt-proof non-flamability, etc. are widely used for clothing and industrial services.

However, in recent years, the raw material of nylon fibers has suddenly risen in price, to further enlarge the difference in price between nylon products and polyester products. So, R&D has been actively conducted on the coating of polyester fibers as a substitute for nylon fibers, since polyester fibers are superior in dimensional stability, strength, light resistance and wide material availability.

However, a coated polyester fiber fabric has an inevitable problem in that the disperse dye in the polyester fibers migrates into the coating membrane, to remarkably stain the product.

For example, if a dark colored coating face of a coated polyester fiber fabric is kept in contact with a light colored or white colored coating face of another coated polyester fiber fabric, the disperse dye on the dark colored face easily migrates onto the light colored or white colored coating face, to stain the latter.

This is because, unlike an acid dye chemically bound with nylon fibers, a disperse dye in polyester fibers loosens the fiber substrate, and the dye molecules are physically pressed into the fiber substrate, to achieve dyeing. It can also be considered that since a disperse dye has solubility and affinity with organic solvents and synthetic resins, the coating causes the disperse dye in the fibers to migrate into the coating membrane.

This problem has been examined by various workers. For example, Japanese Patent Laid-Open No. 85-45686 proposes prevention of the migration of a subliming dye using a fine metal powder of aluminum, copper or silver, etc. or a metal oxide as potassium titanate, titanium dioxide or stannic oxide, each poor in the disperse dye. Japanese Patent Laid-Open No. 83-4873 and Japanese Patent Publication No. 87-53632 propose application of a water repellent agent with perfluoroalkyl groups to a fiber structure with a polyurethane resin membrane containing porous particles mainly composed of $SiO_2$. Japanese Patent Laid-Open No. 92-174771 proposes coating with a resin composition containing an organic metal coordination compound.

However, these prior proposals are not perfect in their prevention of disperse dye migration and staining, or have their ability to prevent migration and staining erased by washing.

Thus, in Japanese Patent Application Nos. 91-43789 and 92-239822, the inventors proposed rendering the dye in the resin colorless using the oxidation action of a salt such as a zirconium compound. However, this technique has a disadvantage in that the dyes used for polyester fiber structures are limited since the oxidation action of such a salt is effective only for specific dyes.

DISCLOSURE OF THE INVENTION

The object of the present invention intended to overcome the above disadvantages of the prior art is to present a coated polyester fiber fabric free from the migration and staining by disperse dyes irrespective of the kind of disperse dye, and a process for easily and stably producing the coated polyester fiber fabric.

To achieve the above object, the present invention has the following constitution.

The present invention provides a coated polyester fiber fabric, produced by coating a polyester fiber structure dyed by a disperse dye, with a resin, comprising an organic peroxide in said coating resin.

The present invention also provides a coated polyester fiber fabric, produced by coating a polyester fiber structure dyed by a disperse dye, with a resin, comprising aromatic rings in said coating resin.

The present invention furthermore provides a process for preparing a coated polyester fiber fabric, comprising the step of coating a polyester fiber structure dyed by a disperse dye, with a resin solution containing an organic peroxide.

The coated polyester fiber fabric of the present invention has excellent fastness against dye migration and staining, and washing durability. On the other hand, the process of the present invention allows the above coated fabric to be produced very simply and stably without requiring any special apparatus, and hence is industrially very effective.

PREFERRED EMBODIMENTS OF THE INVENTION

Figure 1:
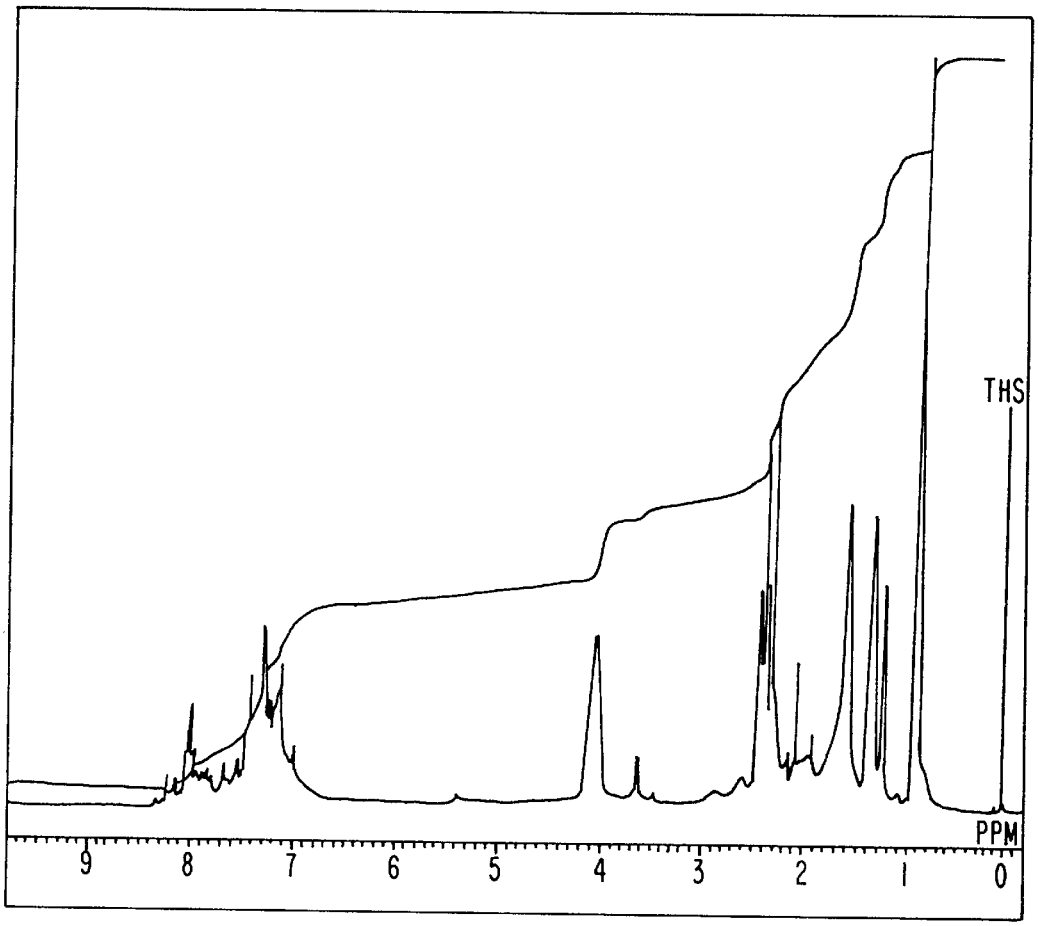
FIG. 1 shows a result of $^1$H-NMR measurement of an acrylic resin containing aromatic rings to be applied for coating a fabric of the present invention.

The present invention has been completed based on the finding that an organic peroxide contained in the resin layer chemically reacts with the disperse dye, acting to erase the color, and can maintain the coated product durable in ability to prevent dye migration and staining on repeated washing.

The prior arts are intended to prevent the disperse dye migration by a resin membrane or fine particles, etc. that are low in affinity and compatibility with the disperse dye. On the contrary, the present invention prevents the disperse dye migration and staining by letting the disperse dye migrating from the fiber fabric chemically react with an organic peroxide contained in the resin layer during the step of coating, for rendering the dye colorless. The present invention has been completed based on a quite new technical idea not found in any of the prior art. It is known that a dye can be rendered colorless by using hydrosulfite for reduction cleaning after dyeing, so consideration can be given to allowing the coating resin to contain the reducing agent (hydrosulfite), for preventing the dye migration and staining. However, the hydrosulfite emits a strong offensive odor from the coated fabric, not preferable in practice.

The organic peroxide used in the present invention is limited to a compound which can chemically react with the disperse dye migrating from the fibers, to render it colorless in the resin limiting the molecular motion. It can be selected, for example, from ketone peroxides, peroxyketals, hydroperoxides, dialkyl peroxides, diacyl peroxides, peroxydicarbonates, peroxy esters, etc. Among them, diacyl peroxides are preferable, these including acetyl peroxide, isobutyryl peroxide, octanoyl peroxide, decanoyl peroxide, lauroyl peroxide, 3,3,5-trimethylhexanoyl peroxide, succinic acid peroxide, benzoyl peroxide, 2,4-dichlorobenzoyl peroxide and toluoyl peroxide. Especially preferred are diacyl peroxides with an aromatic ring such as benzoyl peroxide, 2,4-dichlorobenzoyl peroxide and toluoyl peroxide.

In the coated fabric of the present invention, the organic peroxide existing in the coating resin is decomposed, to generate a radical which attacks the disperse dye migrating from the dyed polyester fibers into the coating resin, for erasing its color.

If a diacyl peroxide with an aromatic ring is used as the organic peroxide, it renders the migrating disperse dye colorless as intended, and in addition, the aromatic ring can exist in the coating resin membrane.

In the present invention, the aromatic rings contained in the coating resin act as follows.

Coating with any conventionally generally preferably used acrylic resin or silicone resin does not contain any aromatic ring. Therefore, the resin is poor in affinity with disperse dyes, since most disperse dyes have aromatic rings.

In the present invention, if aromatic rings are contained in the coating resin, the affinity between the coating resin and the disperse dye can be enhanced. As a result, even if there remains a certain amount of the dye not rendered colorless, the migration of the remaining dye in the resin is inhibited by the affinity.

If a diacyl peroxide with an aromatic ring is used as the organic peroxide, the radical generated by the decomposition of the diacyl peroxide during coating attacks the disperse dye migrating from the dyed polyester fibers into the coating resin, for erasing its color. Furthermore, it is believed that the decomposed diacyl peroxide also attacks the coating resin, to be combined with the coating resin, so adding the aromatic ring to the coating resin.

Therefore, if a diacyl peroxide with an aromatic ring is used as the organic peroxide, the aromatic ring exists in the coating resin after completion of coating. This is evident from a comparison with the use of an acrylic resin or silicone resin not containing any aromatic ring in the basic molecular structure as the coating resin. If a diacyl peroxide with an aromatic ring is used as the organic peroxide in the acrylic resin or silicone resin, the coating resin measured after completion of coating by $^1$H-NMR shows absorption peaks attributable to the aromatic rings, which do not appear when the acrylic resin only or the silicone resin only is used.

The absorption peaks attributable to the aromatic rings are not lowered so much in peak intensity even if the coated fabric is dry-cleaned 20 to 30 times.

In the present invention, the drying of the coating is effected in a temperature range higher than the decomposition temperature of the organic peroxide and higher than the glass transition temperature of the coating resin. All the aromatic rings brought by the diacyl peroxide with an aromatic ring used as the organic oxide do not vanish from the coating resin by the decomposition, evaporation, etc. during such coating. This can be confirmed by the absorption peaks attributable to the aromatic rings shown by the coating resin measured after completion of coating by $^1$H-NMR.

On the other hand, if the coating resin of a fabric coated with an acrylic resin only or a silicone resin only (conventional product) is measured by $^1$H-NMR after completion of coating, absorption peaks attributable to the aromatic rings as observed in the present invention cannot be observed. That is, it can be estimated that the organic peroxide which may be used as a polymerization initiator for producing the acrylic resin or silicone resin does not provides the absorption peaks attributable to the aromatic rings observed in the present invention.

The "absorption peaks attributable to the aromatic rings" are observed when the resin of the coated fabric is measured by $^1$H-NMR in $CDCL_3$ (chloroform substituted by heavy hydrogen) solvent, using tetramethylsilane as the internal standard. The peaks refer to the peaks observed in a chemical shift range from 6 ppm to less than 9 ppm.

In the coated fabric of the present invention, the ratio of the number of aromatic ring protons to the number of aliphatic protons in the coating resin should be preferably 1/100 or more having regard to the affinity between the coating resin and the disperse dye. The "ratio of the number of aromatic ring protons to the number of aliphatic protons" is obtained by measuring the $^1$H-NMR of the resin in the coated fabric in $CDCL_3$ (chloroform substituted by heavy hydrogen), using tetramethylsilane as the internal standard. The absorption peaks observed in a chemical shift range from 6 ppm to less than 9 ppm are identified as aromatic ring protons, and their integral value is obtained. On the other hand, the absorption peaks observed in a range from 0.2 ppm to less than 6 ppm are identified as aliphatic protons, and their integral value is obtained. Subsequently, the ratio of the integral value of aromatic ring protons to the integral value of aliphatic protons is obtained.

That is,

Ratio of the number of aromatic ring protons to the number of aliphatic protons=(Integral value of aromatic ring protons)/(Integral value of aliphatic protons)

Figure 2:
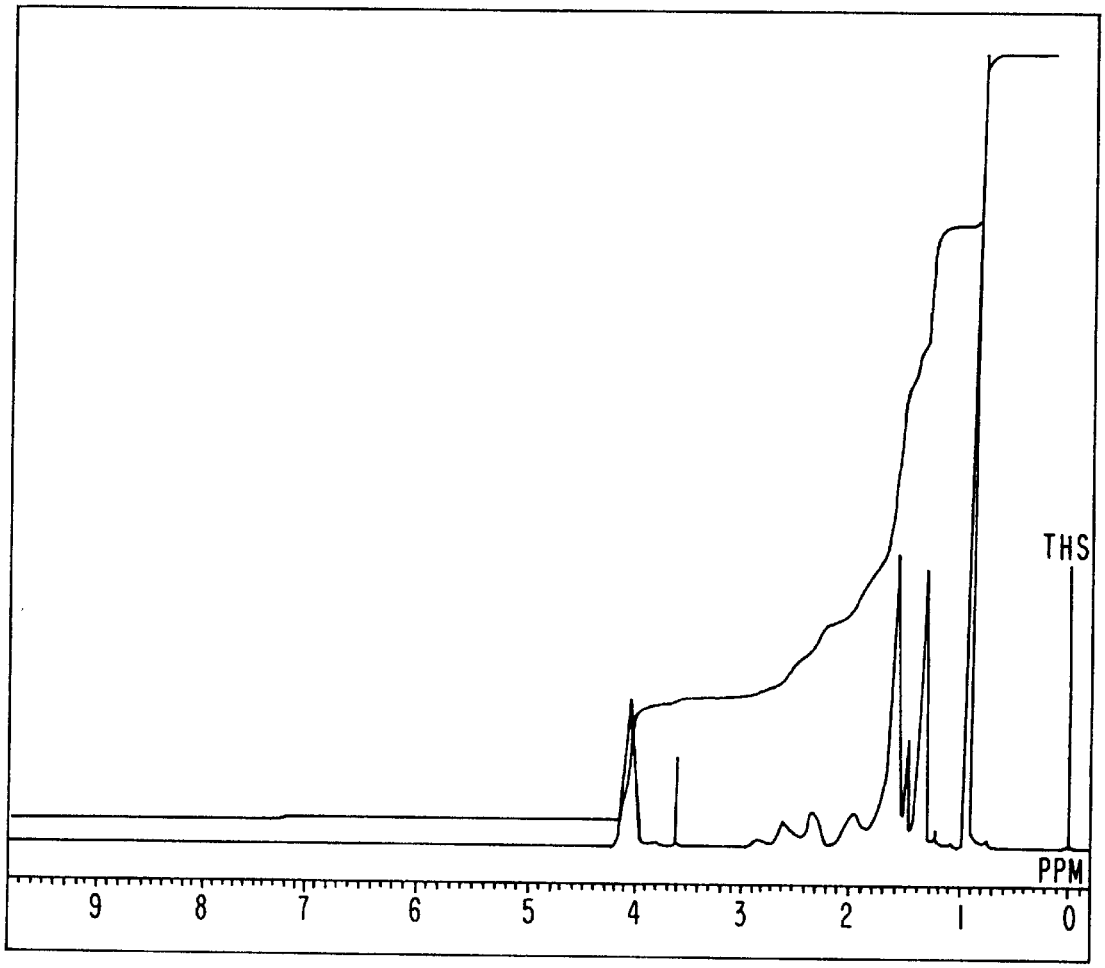
FIG. 2 shows a result of $^1$H-NMR measurement of an acrylic resin alone to be applied for coating a conventional fabric.

Results of the above $^1$H-NMR measurements are shown in FIGS. 1 and 2.

FIG. 1 shows a result of $^1$H-NMR measurement of an acrylic resin containing aromatic rings applied to a fabric of the present invention.

FIG. 2 shows a result of $^1$H-NMR measurement of an acrylic resin alone applied to a conventional fabric.

The disperse dye migrates greatly in the step of coating, especially during drying, so the organic peroxide preferably used in the present invention is an organic peroxide, the decomposition temperature of which, upon heating, is almost as high as the drying temperature for the coating. Specifically, it is preferable that more than half of the organic peroxide is decomposed during drying, though this depends upon the adopted drying temperature and time. More specifically, an organic peroxide having a decomposition temperature upon heating preferably higher than 60° C., more preferably higher than 80° C., can be used. The upper limit of the decomposition temperature is not especially limited but is generally about 150° C.

The amount of the organic peroxide used should be preferably 0.2 wt % or more based on the amount of the solvent contained in the coating resin solution in order to achieve sufficient effect, and preferably 20 wt % or less having regard to the discoloration and loss of softness by stiffening of the dyed fabric. A more preferable range is from 0.5 to 10 wt %.

The polyester fiber structure in the present invention is not especially limited and can be a woven fabric, knitted fabric or nonwoven fabric, etc. of 100% polyester, or a blended yarn fabric, blended fiber fabric, twisted union fiber fabric, woven union fabric, knitted union fabric, etc. containing polyester fibers. However, the effect of the present invention can be remarkably obtained with a fiber structure of 100% polyester or containing large amount of polyester fibers.

The dyeing of the polyester fabric to be coated in the present invention is not especially limited, and neither special disperse dyes nor special dyeing conditions are required. Any polyester fabric dyed as usual by azo or quinone dyes, etc. can be used.

The resin to be coated in the present invention can be freely selected from various resins to be generally coated such as polyurethane resins, acrylate or methacrylate resins, silicone resins, polyvinyl alcohol resin, vinyl chloride resins, vinyl acetate resins, cellulose resins and their composite resins. Among them, acrylic resins and silicone resins are preferable.

The process for preparing the coated polyester fiber fabric of the present invention is described below.

The coated polyester fiber fabric of the present invention can be obtained by mixing and dissolving an organic peroxide into a solution of any of the above resins, or by mixing and dissolving a resin solution prepared beforehand and an organic peroxide dissolved in the same solvent, and applying the solution onto a polyester fiber structure.

If the solvent for dissolving the coating resin is a solvent with an aromatic ring such as toluene or xylene, it is believed that the radical generated from the organic peroxide also attacks the solvent, to release radicals of the solvent, causing the aromatic ring as part of the molecular structure of the solvent to be combined with the coating resin, and causing the solvent to be higher in molecular weight and resinified. Therefore, in the present invention, it is preferable in order to achieve a better effect that a solvent with an aromatic ring such as toluene or xylene is used as the solvent in addition to the use of a diacyl peroxide with an aromatic ring as the organic peroxide as described before.

The resin coating method is not especially limited and any ordinary method can be used.

If a dry coagulation method, which a fiber fabric coated with a resin solution containing a proper amount of an organic peroxide according to the present invention is dried to remove the solvent, is used in the present invention, the effect of the present invention can be remarkably exhibited. If the disperse dye is extracted with the resin solvent, in a drying process of a dry coagulation method, to migrate into the resin from the polyester fibers dyed by the disperse dye, the disperse dye is decomposed by the organic peroxide in the resin, to be rendered colorless. Furthermore, the dye rendered colorless in the present invention remains colorless to cause very slight staining even if it migrates into another resin membrane.

In the present invention, the reason why the above effect can be obtained is not clear, but it can be estimated that the dye molecule is severed by an oxidation reaction, to be rendered colorless, or that the resonance structure is changed for rendering the dye colorless.

EXAMPLES

The present invention is described below in more detail in reference to examples.

The evaluation of fastness against dye migration and staining in the examples was effected according to the following method.

A specimen (5 cm×5 cm) coated on one side with a resin and two blank sheets (of the same fabric as used for the specimen and coated with the same resin as used for the specimen, 5 cm×5 cm) were held between two glass sheets, so that the coating faces of the blank sheets might kept in contact with both the sides of the specimen, and with a load of 4.5 kilograms applied, they were allowed to stand in a constant temperature drying oven (120°±2° C.) for 80 minutes, and allowed to cool. The grade of dye migration from the specimen to the blank sheets was judged with reference to a staining gray scale.

For the washing durability of fastness against dye migration and staining, a specimen was washed according to JIS L 1096 (Methods of Using A Stirrer Type Washing Machine), and fastness against dye migration and staining was judged according to the above method, for evaluation of washing durability. The results are shown in parentheses in the columns headed "Fastness against dye migration and staining" in Tables 1 and 2.

Furthermore, the ratio of the number of aromatic ring protons to the number of aliphatic protons was obtained by measuring $^1$H-NMR of the resin in the coated fabric. The $^1$H-NMR was measured in $CDCL_3$ (chloroform substituted by heavy hydrogen) solvent, using tetramethylsilane as the internal standard. The peaks in a chemical shift range from 6 ppm to less than 9 ppm were identified as aromatic ring protons, and the integral value was obtained. On the other hand, the absorption peaks observed in a range from 0.2 ppm to less than 6 ppm were identified as aliphatic protons, and the integral value was obtained. Then, the ratio was obtained from the following formula. The ratio obtained is indicated as "P ratio" in Tables 1 and 2.

Ratio of the number of aromatic ring protons to the number of aliphatic protons=(Integral value of aromatic ring protons)/(Integral value of aliphatic protons)

The following coating resins were used in Examples and Comparative Examples.

Acrylic resin (Criscoat P-1018A a reaction acryl resin having high viscosity produced by Dainippon Ink & Chemicals, Inc.)

Silicone resin (Toray Silicone SD8001, an addition reaction type silicon rubber product produced by Toray Silicone K.K.)

Example 1

A plain weave obtained by using 50-denier warp threads and 75-denier weft threads of polyester filaments was dyed using an azo disperse dye (C. I. Dispers 0-29, C. I. Dispers R-127 or C. I. Dispers R-167) at 3%o.w.f. at a temperature of 130° C. for 60 minutes, washed using a conventional reducing agent, dried, and thermally set at 180° C., to obtain a dyed fabric to be coated.

On the other hand, an acrylic resin toluene solution of 15% in solid content was prepared, and benzoyl peroxide was mixed and dissolved into the solution at room temperature to achieve a benzoyl peroxide content of 5 wt% based on the amount of the solvent of the resin solution, for preparing a coating resin solution.

The resin solution was applied onto the above dyed fabric using a knife coater, and dried by a dry coagulation method at 130° C. for 1 minute and heat-treated at 160° C. for 1 minute, for membrane formation, to obtain a coated fabric with the coating in an amount of 25 g/m$^2$.

The results of evaluation on the fastness against dye migration and staining of the coated fabrics are shown in Table 1.

Examples 2 to 4

The organic peroxides and coating resins shown in Table 1 were used for coating as in Example 1.

The results of evaluation on the fastness against dye migration and staining of the coated fabrics are shown in Table 1.

Comparative examples 1 and 2

An acrylic resin containing neither benzoyl peroxide nor 2,4-dichlorobenzoyl peroxide as the organic peroxide (Comparative Example 1) or a silicone resin containing neither (Comparative Example 2) was applied to the dyed fabric obtained in Example 1, and dried as done in Example 1.

The results of evaluation on the fastness against dye migration and staining of the coated fabrics are shown in Table 1.

As can be seen from Table 1, the coated fabrics of Examples 1 to 4 had far more excellent fastness against dye migration and staining than the coated fabrics not containing any organic peroxide of Comparative Examples 1 and 2. The former were also excellent in washing durability.

Examples 5 to 8 and comparative examples 3 and 4

Coated fabrics were prepared as in Examples 1 to 4 and Comparative Examples 1 and 2, except that polyester fibers dyed by a quinone disperse dye were used. The results of evaluation are shown in Table 2.

As can be seen from Table 2, also when fabrics dyed by quinone dyes were used, the coated fabrics of the present invention showed excellent fastness against dye migration and staining, and excellent washing durability.

TABLE 1

| | Condition | | Fastness against dye migration and staining (grade) | | | |
|---|---|---|---|---|---|---|
| | Organic peroxide | Coating resin | Dye (1) | Dye (2) | Dye (3) | P ratio |
| Example 1 | BPO | Acrylic | 4-5 (4-5) | 5 (5) | 5 (5) | 8.75/100 |
| Example 2 | DCBPO | Acrylic | 4-5 (4-5) | 5 (5) | 5 (5) | 3.35/100 |
| Example 3 | BPO | Silicone | 4-5 (4-5) | 5 (5) | 5 (5) | 8.62/100 |
| Example 4 | DCBPO | Silicone | 4-5 (4-5) | 5 (5) | 5 (5) | 3.30/100 |
| Comparative example 1 | Nil | Acrylic | 2 (2) | 2 (2) | 2 (2) | 0/100 |
| Comparative example 2 | Nil | Silicone | 2 (2) | 2 (2) | 2 (2) | 0/100 |

Parenthesized numerals show grades of fastness against dye migration and staining after washing
Dye (1): C.I. Dispers O-29 (azo disperse dye)
Dye (2): C.I. Dispers R-127 (azo disperse dye)
Dye (3): C.I. Dispers R-167 (azo disperse dye)
BPO: Benzoyl peroxide
DCBPO: 2,4-dichlorobenzoyl peroxide
P ratio: Ratio of the number of aromatic ring protons to the number of aliphatic protons

TABLE 2

| | Condition | | Fastness against dye migration and staining (grade) | | |
|---|---|---|---|---|---|
| | Organic peroxide | Coating resin | Dye (4) | Dye (5) | P ratio |
| Example 5 | BPO | Acrylic | 4-5 (4-5) | 5 (5) | 8.75/100 |
| Example 6 | DCBPO | Acrylic | 4-5 (4-5) | 5 (5) | 3.35/100 |
| Example 7 | BPO | Silicone | 4-5 (4-5) | 5 (5) | 8.62/100 |

TABLE 2-continued

| | Condition | | Fastness against dye migration and staining (grade) | | |
|---|---|---|---|---|---|
| | Organic peroxide | Coating resin | Dye (4) | Dye (5) | P ratio |
| Example 8 | DCBPO | Silicone | 4-5 (4-5) | 5 (5) | 3.30/100 |
| Comparative example 3 | Nil (2) | Acrylic (2) | 2 | 2 | 0/100 |
| Comparative example 4 | Nil (2) | Silicone (2) | 2 | 2 | 0/100 |

Parenthesized numerals show grades of fastness against dye migration and staining after washing
Dye (4): C.I. Dispers B-27 (quinone disperse dye)
Dye (5): C.I. Dispers B-125 (quinone disperse dye)
BPO: Benzoyl peroxide
DCBPO: 2,4-dichlorobenzoyl peroxide
P ratio: Ratio of the number of aromatic ring protons to the number of aliphatic protons

We claim:

1. A coated polyester fiber fabric which is resistant to dye migration, produced by coating polyester fibers dyed by a disperse dye, with a coating resin, comprising an organic peroxide in said coating resin, wherein the coating resin is an acrylic resin or a silicone resin and the organic peroxide is selected from the group consisting of benzoyl peroxide, 2,4-dichlorobenzoyl peroxide and toluoyl peroxide.

2. A coated polyester fiber fabric which is resistant to dye migration, produced by coating polyester fibers dyed by a disperse dye, with a coating resin, comprising aromatic rings in said coating resin, wherein the coating resin is an acrylic resin or a silicone resin including an organic peroxide selected from the group consisting of benzoyl peroxide, 2.4-dichlorobenzoyl peroxide and toluoyl peroxide.

3. A coated polyester fiber fabric which is resistant to dye migration, according to claim 2, wherein the ratio of the number of aromatic ring protons to the number of aliphatic protons contained in the coating resin is 1/100 or more.

4. A process for preparing a coated polyester fiber fabric which is resistant to dye migration, comprising the step of coating polyester fibers dyed by a disperse dye, with a coating resin solution comprising an acrylic resin or a silicone resin containing an organic peroxide selected from the group consisting of benzoyl peroxide, 2,4-dichlorobenzoyl peroxide and toluoyl peroxide.

5. A coated polyester fiber fabric which is resistant to dye migration according to claim 2, wherein the ratio of the number of aromatic ring protons to the number of aliphatic protons contained in the coating resin is 1/100 or more.

6. A method for rendering a disperse dyed polyester fabric dye migration resistant comprising:

coating polyester fibers with an organic peroxide selected from the group consisting of benzoyl peroxide, 2,4-dichlorobenzoyl peroxide and toluoyl peroxide in a coating resin comprising an acrylic resin or a silicone resin, thereby causing any disperse dye migrating from said disperse dyed polyester fabric to chemically react with said organic peroxide to render said migrating disperse dye colorless.

7. A coated disperse dyed polyester fiber fabric which has been rendered dye migration resistant, said fabric being prepared by the method of claim 6.

8. The coated polyester fiber fabric of claim 2 wherein the aromatic rings are obtained by adding a diacyl peroxide to the coating resin, wherein said diacyl peroxide is selected from the group consisting of benzoyl peroxide, 2,4-dichlorobenzoyl peroxide, and toluoyl peroxide.

* * * * *